US011506142B2

(12) United States Patent
Manabe et al.

(10) Patent No.: US 11,506,142 B2
(45) Date of Patent: Nov. 22, 2022

(54) TIMING CHAIN COVER AND MOUNTING STRUCTURE FOR TIMING CHAIN COVER

(71) Applicant: TOYOTA JIDOSHA KABUSHIKI KAISHA, Toyota (JP)

(72) Inventors: Kazuyoshi Manabe, Toyota (JP); Koki Miyashiro, Toyota (JP); Taiki Kawate, Susono (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/654,500

(22) Filed: Mar. 11, 2022

(65) Prior Publication Data

US 2022/0290628 A1 Sep. 15, 2022

(30) Foreign Application Priority Data

Mar. 12, 2021 (JP) ..... JP2021-039902

(51) Int. Cl.
*F02F 7/00* (2006.01)
*F01L 1/02* (2006.01)

(52) U.S. Cl.
CPC ..... *F02F 7/008* (2013.01); *F01L 1/022* (2013.01); *F02F 7/0073* (2013.01)

(58) Field of Classification Search
CPC ..... F02F 7/0073; F02F 7/008; F01L 1/022
See application file for complete search history.

(56) References Cited

U.S. PATENT DOCUMENTS

2002/0035982 A1* 3/2002 Kobayashi ..... F01L 1/022 123/90.31

FOREIGN PATENT DOCUMENTS

| | | | | |
|---|---|---|---|---|
| JP | H08183945 | A | | 7/1996 |
| JP | 2006242138 | A | | 9/2006 |
| JP | 2010031666 | A | * | 2/2010 |
| JP | 2010076345 | A | * | 4/2010 |
| JP | 2016113614 | A | | 6/2016 |

* cited by examiner

*Primary Examiner* — Kevin A Lathers
(74) *Attorney, Agent, or Firm* — Dickinson Wright, PLLC

(57) ABSTRACT

Provided is a timing chain cover that allows suppressing vibration transmission. A timing chain cover of the present disclosure houses a timing chain transmitting a rotative force of a crankshaft to a camshaft in one end side of an internal combustion engine. The timing chain cover includes a chain cover main body and a damping resin layer formed on an abutment surface of the chain cover main body. The abutment surface abuts on an internal combustion engine main body. The damping resin layer contains a heat resistant resin and a damping filler. The damping filler converts a vibration energy into a heat energy.

5 Claims, 7 Drawing Sheets

TIMING CHAIN COVER AND MOUNTING STRUCTURE FOR TIMING CHAIN COVER

CROSS REFERENCE TO RELATED APPLICATIONS

The present application claims priority from Japanese patent application JP 2021-039902 filed on Mar. 12, 2021, the entire content of which is hereby incorporated by reference into this application.

BACKGROUND

Description of Related Art

The present disclosure relates to a timing chain cover that houses a timing chain transmitting a rotative force of a crankshaft to a camshaft in one end side of an internal combustion engine, and a mounting structure for the timing chain cover.

Background Art

Conventionally, in an internal combustion engine, such as an engine of a vehicle, a camshaft driving mechanism includes a crank sprocket integrally rotatably mounted to one end side in the axial direction of a crankshaft, an intake cam sprocket integrally rotatably mounted to one end side in the axial direction of an intake camshaft, and an exhaust cam sprocket integrally rotatably mounted to one end side in the axial direction of an exhaust camshaft. The camshaft driving mechanism includes a timing chain that transmits a rotative force of the crankshaft to each of the cam sprockets. A timing chain cover protecting the timing chain and the like is mounted to a surface in one end side of the internal combustion engine main body including a cylinder block and the like, and the camshaft driving mechanism is housed in an internal space of the timing chain cover.

As a mounting structure for the timing chain cover, for example, JP 2006-242138 A discloses a timing chain cover structure in which a crank pulley integrally rotatably coupled to one end of a crankshaft projecting outward compared with the timing chain cover, a serpentine belt driving each of various auxiliary machines by the crank pulley, and a belt tensioner adjusting a tensile force of the serpentine belt are disposed in an outer surface side of the timing chain cover.

SUMMARY

In the timing chain cover structure disclosed in JP 2006-242138 A, the belt tensioner is mounted via a damping structural member that provides an elastic force to a predetermined portion in the outer surface side of the timing chain cover and suppresses a vibration near the predetermined portion. Accordingly, a radiated sound caused by the vibration of the timing chain cover at the mounting portion of the belt tensioner can be reliably reduced.

In the mounting structure for the timing chain cover disclosed in JP 2006-242138 A, the vibration transmitted from another portion in the internal combustion engine to the timing chain cover is suppressed by the damping structural member, thereby allowing the reduction of the radiated sound. However, the vibration transmission itself between the other portion in the internal combustion engine and the timing chain cover failed to be suppressed. Therefore, the sufficient noise suppression was difficult. Meanwhile, with the electrification of vehicles, such as an automobile, a demand standard for an NV (noise and vibration) performance has increased more than ever before.

The present disclosure has been made in consideration of such a problem and provides a timing chain cover that allows suppressing a vibration transmission, and a mounting structure for the timing chain cover.

In order to solve the above-described problem, a timing chain cover of the present disclosure is for housing a timing chain transmitting a rotative force of a crankshaft to a camshaft in one end side of an internal combustion engine. The timing chain cover comprises a chain cover main body and a damping resin layer formed on an abutment surface of the chain cover main body. The abutment surface abuts on an internal combustion engine main body. The damping resin layer contains a heat resistant resin and a damping filler. The damping filler converts a vibration energy into a heat energy.

The timing chain cover of the present disclosure allows suppressing the vibration transmission.

In the timing chain cover, the damping resin layer may have a thickness of 10 μm or more.

The present disclosure provides a mounting structure for a timing chain cover. The timing chain cover is mounted to an internal combustion engine main body with the mounting structure. The timing chain cover houses a timing chain transmitting a rotative force of a crankshaft to a camshaft in one end side of the internal combustion engine. The mounting structure comprises a damping resin layer disposed between an abutment surface of a chain cover main body included in the timing chain cover and an abutment surface of the internal combustion engine main body. The damping resin layer contains a heat resistant resin and a damping filler. The damping filler converts a vibration energy into a heat energy.

The mounting structure of the present disclosure allows suppressing the vibration transmission.

In the mounting structure, the damping resin layer may be formed on the abutment surface of the chain cover main body, and may be included in the timing chain cover.

In the mounting structure, the damping resin layer may have a thickness of 10 μm or more.

Effect

The present disclosure allows suppressing the vibration transmission.

DETAILED DESCRIPTION OF THE EMBODIMENTS

The following describes embodiments of a timing chain cover and a mounting structure for the timing chain cover according to the present disclosure. Hereinafter, the "timing chain cover" is referred to as a "chain cover" in short in some cases.

First Embodiment

Figure 1:
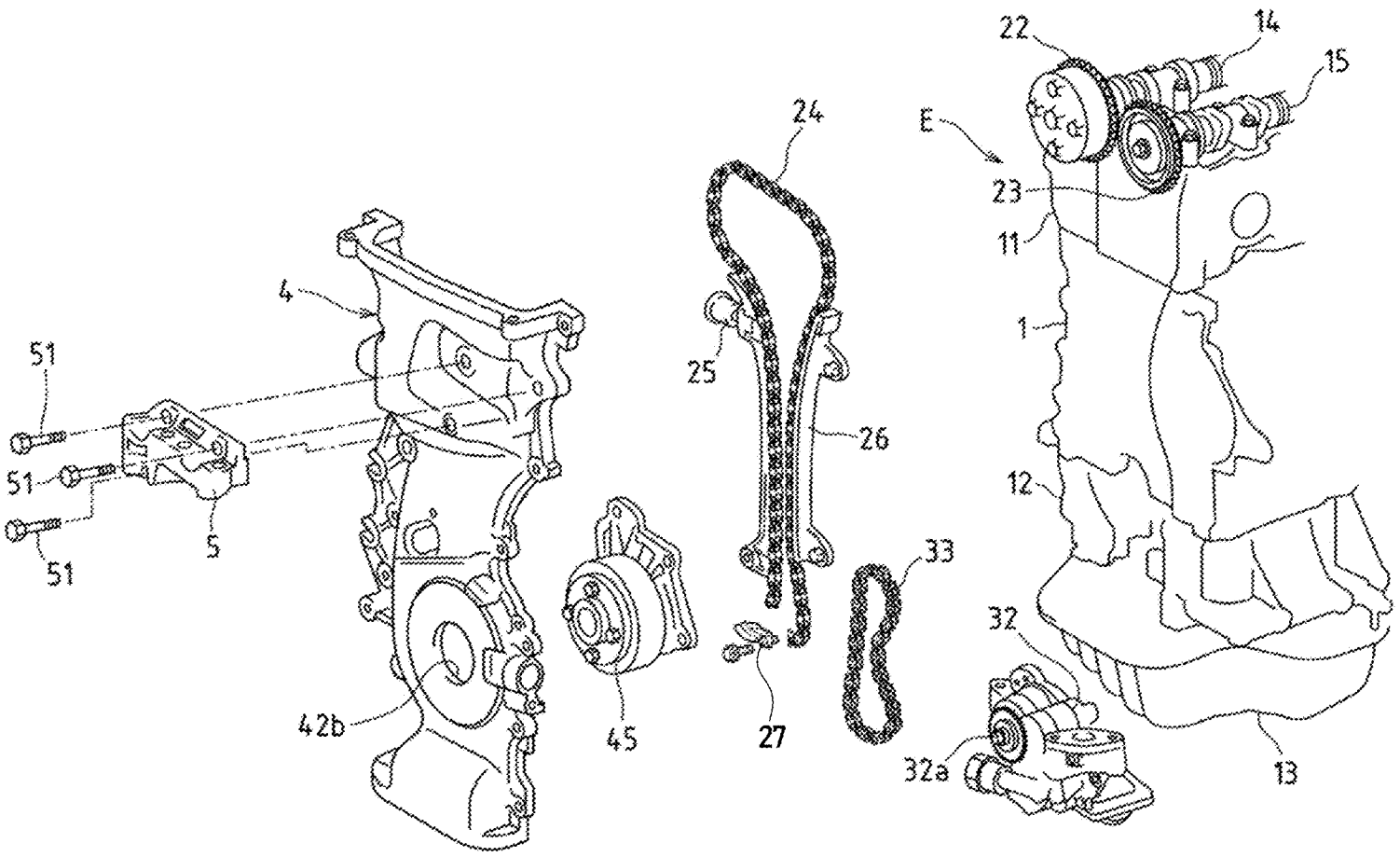
FIG. 1 is an exploded perspective view schematically illustrating an engine to which a mounting structure for a timing chain cover according to a first embodiment is applied.
Figure 2:
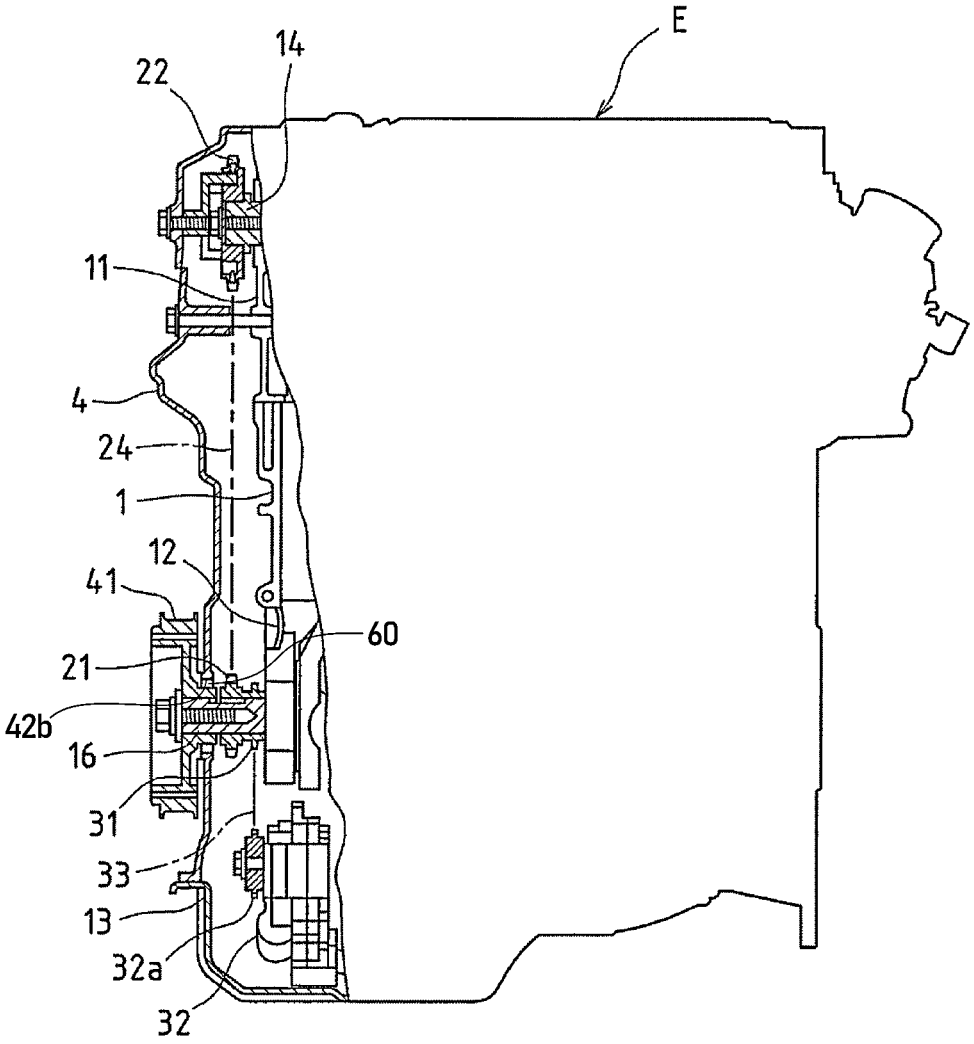
FIG. 2 is a schematic cross-sectional view of the engine illustrating the mounting structure for the timing chain cover illustrated in FIG. 1.
Figure 3A:
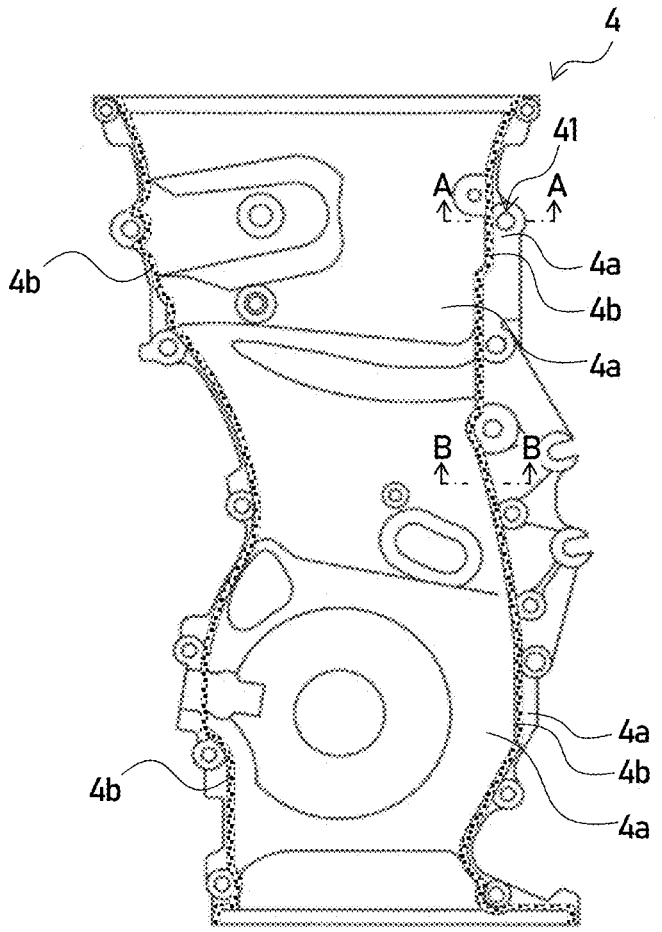
FIG. 3A is a schematic back view illustrating a back surface in an engine main body side of the timing chain cover illustrated in FIG. 1.
Figure 3B:
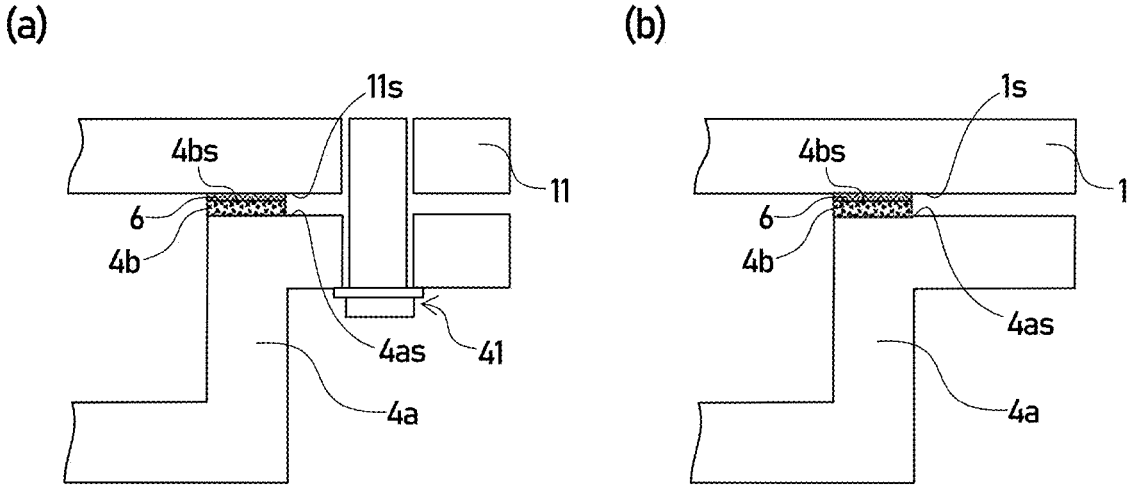
FIG. 3B(a) is a schematic cross-sectional view illustrating the mounting structure taken along a line A-A in FIG. 3A, and FIG. 3B(b) is a schematic cross-sectional view illustrating the mounting structure taken along a line B-B in FIG. 3A.

First, the timing chain cover and its mounting structure according to the first embodiment will be exemplified. FIG. 1 is an exploded perspective view schematically illustrating an engine to which the mounting structure for the timing chain cover according to the first embodiment is applied. FIG. 2 is a schematic cross-sectional view of the engine illustrating the mounting structure for the timing chain cover illustrated in FIG. 1. FIG. 3A is a schematic back view illustrating a back surface in an engine main body side of the timing chain cover illustrated in FIG. 1. FIG. 3B(a) is a schematic cross-sectional view illustrating the mounting structure taken along the line A-A in FIG. 3A, and FIG. 3B(b) is a schematic cross-sectional view illustrating the mounting structure taken along the line B-B in FIG. 3A.

In an engine E (internal combustion engine) illustrated in FIG. 1, a cylinder head 11 (engine main body) is mounted to an upper portion of a cylinder block 1 (engine main body), and an oil pan 13 is mounted to a lower portion of the cylinder block 1 via a crankcase 12 (engine main body).

The cylinder block 1 and the cylinder head 11 are made of a metal, such as iron (cast iron), aluminum, and magnesium, an alloy containing them, or the like. The cylinder head 11 is fastened to the cylinder block 1 by a plurality of bolts via a gasket such as a metal gasket and a liquid gasket.

On the cylinder head 11, an intake camshaft 14 and an exhaust camshaft 15 are located. As illustrated in FIG. 2, on the crankcase 12, a crankshaft 16 is located. The crankshaft 16 rotatably drives each of the camshafts 14, 15. The following describes a camshaft driving mechanism for rotatably driving each of the camshafts 14, 15.

As illustrated in FIG. 1 and FIG. 2, the camshaft driving mechanism includes a crank sprocket 21 integrally rotatably mounted to one end side in the axial direction of the crankshaft 16, an intake cam sprocket 22 integrally rotatably mounted to one end side in the axial direction of the intake camshaft 14, and an exhaust cam sprocket 23 integrally rotatably mounted to one end side in the axial direction of the exhaust camshaft 15. The camshaft driving mechanism further includes a timing chain 24 that transmits a rotative force of the crankshaft 16 to each of the cam sprockets 22, 23. The timing chain 24 is wound around the crank sprocket 21 and the respective cam sprockets 22, 23, and the driving rotation of the crank sprocket 21 causes the driven rotations of the respective cam sprockets 22, 23. FIG. 1 illustrates a chain tensioner device 25 that adjusts a tensile force of the timing chain 24, a chain vibration damper 26 that guides a stretching portion of the timing chain 24 positioned between the exhaust cam sprocket 23 and the crank sprocket 21, and a timing chain guide 27. The timing chain 24 slides with components such as the crank sprocket 21 and the respective cam sprockets 22, 23 via an engine oil.

As illustrated in FIG. 1 and FIG. 2, an oil pump driving mechanism that rotatably drives an oil pump 32 by the crankshaft 16 is disposed below the camshaft driving mechanism. The oil pump driving mechanism includes an oil pump driving sprocket 31 integrally rotatably mounted to the crankshaft 16 in the crankcase 12 side compared with the crank sprocket 21, and an oil pump sprocket 32*a* integrally rotatably mounted to the oil pump 32 in one end side. The oil pump driving mechanism further includes an oil pump drive chain 33 that is wound around the oil pump driving sprocket 31 and the oil pump sprocket 32*a* and causes the driven rotation of the oil pump sprocket 32*a* by the driving rotation of the oil pump driving sprocket 31.

As illustrated in FIG. 1 and FIG. 2, the camshaft driving mechanism and the oil pump driving mechanism are housed in an internal space of a timing chain cover 4 in one end side of the engine E. The timing chain cover 4 is mounted to a surface in one end side of the engine main body (internal combustion engine main body) including the cylinder block 1 and the like. In the internal space of the timing chain cover 4, an engine oil for lubricating the timing chain 24 is circulated. The timing chain cover 4 has a role of protecting the timing chain 24 and a role for avoiding spattering of the engine oil.

As illustrated in FIG. 3A and FIGS. 3B(a) and 3B(b), the timing chain cover 4 according to the first embodiment includes a chain cover main body 4*a* made of an aluminum alloy and a damping resin layer 4*b* formed on an abutment surface 4*as* that abuts on the engine main body of the chain cover main body 4*a*. As illustrated in FIG. 3B(a) and FIG. 3B(b), a liquid gasket (FIPG: Formed In Place Gasket) 6 as a sealing member is disposed on a surface 4*bs* of the damping resin layer 4*b*. The timing chain cover 4 is joined to the engine main body including the cylinder block 1, the cylinder head 11, and the like via the liquid gasket 6. The engine oil leakage from the outer edge of the timing chain cover 4 is avoided by the liquid gasket 6. FIG. 3B(a) illustrates a bolt 41 for fastening the chain cover main body 4*a* to the cylinder head 11.

As illustrated in FIG. 2, the crankshaft 16 has one end in the axial direction that is inserted through an opening 42*b* of the timing chain cover 4 and projects outward compared with the timing chain cover 4. A crank pulley 41 for driving various kinds of auxiliary machines (alternator, air conditioner compressor, and the like) by belt transmission is integrally rotatably mounted to the one end in the axial direction of the crankshaft 16. An oil seal 60 that avoids the engine oil leakage is disposed in a gap of the opening 42*b* of the timing chain cover 4 through which the crankshaft 16 is inserted.

As illustrated in FIG. 1, for the engine E, an engine mount bracket 5 for suspending the engine itself on a chassis is disposed at the timing chain cover 4. The material of the engine mount bracket 5 is an iron (cast iron) having a high rigidity. The engine mount bracket 5 is fastened to the timing chain cover 4 by a plurality of fastening bolts 51, 51, . . . , and also fastened to the cylinder head 11. Furthermore, a water pump 45 is disposed. The water pump 45 is driven by the rotative force of the crankshaft 16 and circulates a cooling water.

In the engine E (internal combustion engine) configured as described above, as illustrated in FIG. 3A and FIGS. 3B(a) and 3B(b), the mounting structure for the timing chain cover 4 according to the first embodiment includes the damping resin layer 4*b* between the abutment surface 4*as* of the chain cover main body 4*a* and the abutment surface of the engine main body (internal combustion engine main body), for example, an abutment surface is of the cylinder block 1, an abutment surface 11*s* of the cylinder head 11, or the like. The damping resin layer 4*b* includes a heat resistant resin and a damping filler that converts a vibration energy into a heat energy. Accordingly, the vibration transmission between the engine main body including the cylinder block 1, the cylinder head 11, and the like and the chain cover main body 4*a* can be suppressed by the damping resin layer 4*b*. Specifically, for example, the vibration transmission, such as a vibration generated by meshing of the timing chain with the tooth part of the sprocket, a vibration generated by a contact between the timing chain and the chain guide, and a vibration generated by combustion in the cylinder block, can be suppressed. Therefore, it can be suppressed that the vibration transmission causes a surface vibration of the chain cover main body 4*a* and a noise is radiated to the outside.

Second Embodiment

Subsequently, a timing chain cover and its mounting structure according to the second embodiment will be exemplified. The timing chain cover according to the second embodiment includes an inner chain cover that abuts on the engine main body including the cylinder block, the cylinder head, and the like, and an outer chain cover that houses the timing chain in an internal space with the inner chain cover.

Figure 4A:
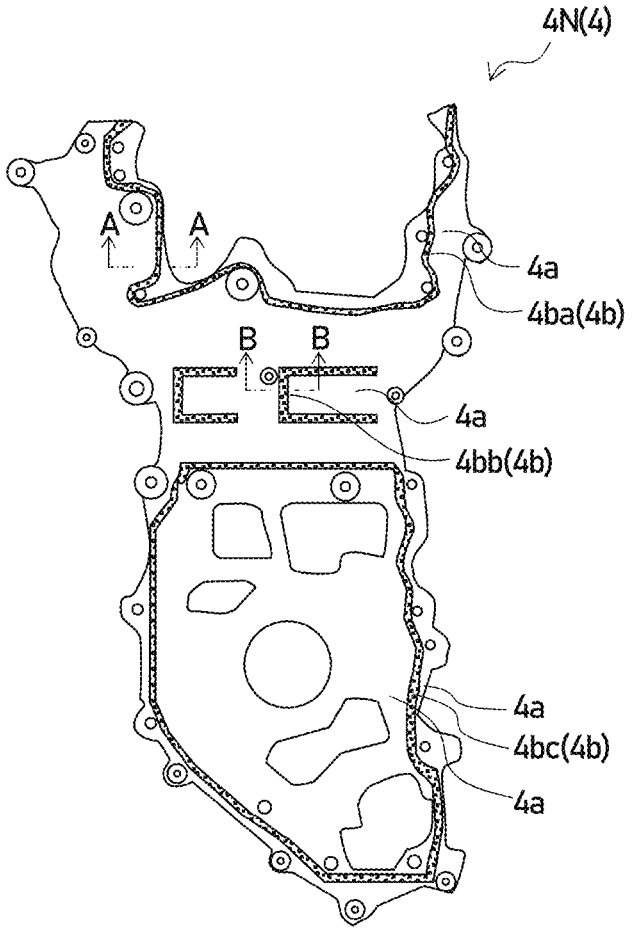
FIG. 4A is a schematic back view illustrating a back surface in an engine main body side of an inner chain cover of a timing chain cover according to a second embodiment.
Figure 4B:
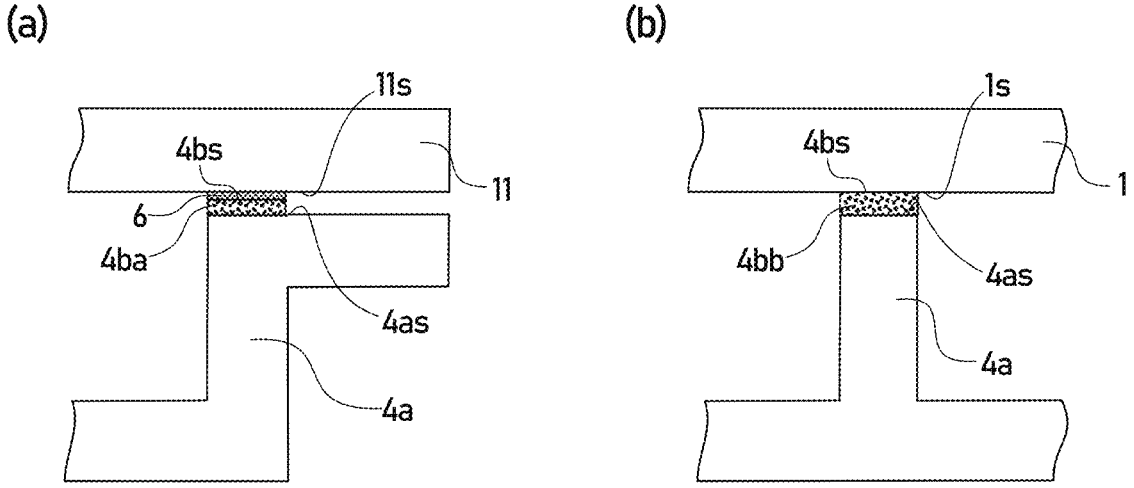
FIG. 4B(a) is a schematic cross-sectional view illustrating a mounting structure of the inner chain cover taken along a line A-A in FIG. 4A, and FIG. 4B(b) is a schematic cross-sectional view illustrating the mounting structure of the inner chain cover taken along a line B-B in FIG. 4A.

FIG. 4A is a schematic back view illustrating a back surface in the engine main body side of the inner chain cover of the timing chain cover according to the second embodiment. FIG. 4B(a) is a schematic cross-sectional view illustrating the mounting structure of the inner chain cover taken along the line A-A in FIG. 4A, and FIG. 4B(b) is a schematic cross-sectional view illustrating the mounting structure of the inner chain cover taken along the line B-B in FIG. 4A.

As illustrated in FIG. 4A and FIGS. 4B(a) and 4B(b), an inner chain cover 4N of the timing chain cover 4 according to the second embodiment includes a chain cover main body 4*a*, and includes an annular damping resin layer 4*ba*, U-shaped damping resin layers 4*bb*, and an annular damping resin layer 4*bc* positioned in the upper side, the intermediate side, and the lower side in FIG. 4A, respectively as the damping resin layer 4*b* formed on the abutment surface 4*as* that abuts on the engine main body (internal combustion engine main body) of the chain cover main body 4*a*. As illustrated in FIG. 4B(a), the liquid gasket 6 is disposed on the surface 4*bs* of the damping resin layer 4*ba* in the upper side. While the illustration is omitted, the liquid gasket is disposed also on the surface of the damping resin layer 4*bc* in the lower side. The timing chain cover 4 is joined to the engine main body including the cylinder block, the cylinder head 11, and the like via these liquid gaskets. The oil leakage from the internal space of the timing chain cover 4 to the outside is avoided by these liquid gaskets. Meanwhile, as illustrated in FIG. 4B(b), the liquid gasket 6 is not disposed on the surface 4*bs* of the damping resin layer 4*bb* in the intermediate side, and the damping resin layer 4*bb* in the intermediate side is directly in contact with the engine main body including the cylinder block 1 and the like.

The mounting structure for the inner chain cover 4N of the timing chain cover 4 according to the second embodiment includes the damping resin layers 4*ba*, 4*bb*, 4*bc* between the abutment surface 4*as* of the chain cover main body 4*a* and the abutment surface of the engine main body, for example, the abutment surface 1*s* of the cylinder block 1 and the abutment surface 11*s* of the cylinder head 11. The damping resin layers 4*ba*, 4*bb*, 4*bc* each include a heat resistant resin and a damping filler that converts a vibration energy into a heat energy. Accordingly, similarly to the first embodiment, the vibration transmission between the engine main body and the chain cover main body 4*a* can be suppressed by the damping resin layer 4*b*. Therefore, it can be suppressed that the vibration transmission causes a surface vibration of the chain cover main body 4*a* and a noise is radiated to the outside.

Accordingly, the timing chain covers and the mounting structures for the timing chain covers according to the embodiments can suppress the vibration transmission between the engine main body and the chain cover main body. Therefore, the noise can be suppressed.

The following describes the respective configurations of the timing chain cover and the mounting structure for the timing chain cover according to the embodiments in detail.

1. Timing Chain Cover

The timing chain cover houses the timing chain that transmits the rotative force of the crankshaft to the camshaft in one end side of the internal combustion engine. The timing chain cover includes the chain cover main body and the damping resin layer.

(1) Chain Cover Main Body

While the chain cover main body is not specifically limited, the chain cover main body may be a main body of a single timing chain cover as the chain cover main body according to the first embodiment, or may be a main body of an inner chain cover of a timing chain cover including the inner chain cover and an outer chain cover as the chain cover main body according to the second embodiment.

While the material of the chain cover main body is not specifically limited, for example, a metal such as aluminum is included.

(2) Damping Resin Layer

The damping resin layer is formed on the abutment surface that abuts on the internal combustion engine main body of the chain cover main body. Here, the "internal combustion engine main body" means a portion of the internal combustion engine to which the timing chain cover is mounted excluding the chain cover. While the internal combustion engine main body is not specifically limited insofar as the internal combustion engine main body is such portion, for example, a cylinder block, a cylinder head, and a crankcase are included. The damping resin layer contains a heat resistant resin and a damping filler that converts a vibration energy into a heat energy.

While the thickness of the damping resin layer is not specifically limited, for example, the thickness is 10 μm or more in some embodiments, may be 20 μm or more, and may be 50 μm or more. This is because the suppressive action on vibration transmission is sufficiently obtained. The thickness of the damping resin layer is, for example, 400 μm or less in some embodiments, may be 200 μm or less, and may be 100 μm or less. This is because the improvement of the suppressive action on vibration transmission is saturated, and the layer formation by coating is facilitated.

While the heat resistant resin is not specifically limited insofar as the heat resistant resin has a heat distortion temperature of 100° C. or more, the heat resistant resin has the heat distortion temperature of 150° C. or more in some embodiments. The exemplary heat resistant resin is not specifically limited, and a polyamide-imide resin, a polyimide resin, a phenol resin, an epoxy resin, a polyethersulfone resin, a polyphenyl sulfide resin, and the like can be included. From the aspect of the workability in forming the coating and the heat resistance to heat generation by friction, the polyamide-imide resin is used in some embodiments. One kind of these heat resistant resins may be used alone, or two or more kinds may be used in combination.

The damping filler converts the vibration energy into the heat energy. While the damping filler is not specifically limited, the material of the damping filler is roughly divided into an easily deformed material with low elastic modulus and a material in which the energy is easily internally dissipated. The easily deformed material with low elastic modulus is, more specifically, a solid, and means a material that notably has both of an elastic property and a viscous property. While every material has both of the elastic property and the viscous property, the easily deformed material with low elastic modulus notably has both of these properties. Therefore, by the damping resin layer containing the easily deformed material with low elastic modulus, the rubber elasticity of the damping resin layer itself in the normal temperature range can be increased. Accordingly, it is considered that the vibration input from outside is effectively absorbed by the damping resin layer and converted into the heat energy, thereby allowing effectively cutting off the vibration transmission. Meanwhile, the material in which the energy is easily internally dissipated has an effect of damping the vibration by diffusely reflecting the vibration on an air layer present in the material and converting the vibration into the heat energy. Accordingly, it is considered that, with the damping resin layer containing the material in which the energy is easily internally dissipated, the vibration transmission can be effectively cut off by the damping resin layer.

The exemplary easily deformed material with low elastic modulus can include a thermoplastic elastomer, a urethane based compound, a polyethylene based compound, an ester copolymer, a soft material such as a silicone resin based material, a rubber based material, and the like. The thermoplastic elastomer generally has a property of rubber at ordinary temperature, and has a performance equivalent to a thermoplastic plastic at high temperature. The exemplary thermoplastic elastomer can include a styrene based thermoplastic elastomer, an olefin based thermoplastic elastomer, a vinyl chloride based thermoplastic elastomer, a urethane based thermoplastic elastomer, an ester based thermoplastic elastomer, an amide based thermoplastic elastomer, and the like. These examples are disclosed in, for example, JP 2016-113614 A and JP 2017-197733 A. The exemplary urethane based compound can include a urethane resin and the like. These examples are disclosed in, for example, JP H08-183945 A. The exemplary polyethylene based compound can include an ethylene homopolymer, a copolymer of ethylene and α-olefin monomer, and the like. These examples are disclosed in, for example, JP 2009-532570 T. The exemplary ester copolymer can include an acrylic acid ester copolymer and the like. These examples are disclosed in, for example, Japanese Patent No. 3209499. The exemplary soft material such as a silicone resin based material can include a polysiloxane based material and the like. These examples are disclosed in, for example, JP 2001-40329 A. The exemplary rubber based material can include a butyl rubber, a fluorine rubber, and the like. These examples are disclosed in, for example, JP 2009-236172 A.

The exemplary material in which the energy is easily internally dissipated can include a microcapsule based material, a low-density material, and the like. Examples of microcapsule based material can include a thermally expandable microcapsule that contains a vapor expanded in a predetermined temperature range in a shell formed of a thermoplastic polymer. These examples are disclosed in, for example, JP 2013-18855 A. The exemplary low-density material includes materials internally including an air layer in general, and can include, specifically, a foam material, a porous body, a nonwoven fabric, a layered compound, and the like. These examples are disclosed in, for example, JP H03-221173 A and Japanese Patent No. 4203589. One kind of the above-described materials of the damping filler may be used alone, or two or more kinds may be used in combination.

The above-described soft material such as a silicone resin based material includes one used for the material of the liquid gasket (FIPG: Formed In Place Gasket). Therefore, by using the soft material such as a silicone resin based material used as the material of the liquid gasket together with the other material of the damping filler, such as a urethane based compound, as the material of the damping filler, both of the desired vibration reduction performance and the desired adhesiveness are provided to the damping resin layer, thereby allowing the damping resin layer to double as the liquid gasket.

The damping resin layer may contain any component such as a solid lubricant and hard particles in addition to the heat resistant resin and the damping filler. This is because the properties such as the wear resistance, the seizure resistance, and the low friction characteristics can be provided to the damping resin layer. The solid lubricant is not specifically limited, and can include polytetrafluoroethylene (PTFE), molybdenum disulfide ($MoS_2$), graphite (black lead), and the like. One kind of the solid lubricants may be used alone, or two or more kinds may be used in combination. The hard particles are not specifically limited, and can include alumina ($Al_2O_3$), silica, and the like. One kind of the hard particles may be used alone, or two or more kinds may be used in combination.

While a volume ratio of the damping filler to a total volume of the heat resistant resin and the damping filler in the damping resin layer is not specifically limited, the volume ratio of the damping filler is in a range of 20 volume % or more and 80 volume % or less in some embodiments, and may be in a range of 40 volume % or more and 60 volume % or less. This is because, with the lower limits or more in these ranges, the vibration energy can be more efficiently converted into the heat energy by the filler. Additionally, this is because, with the upper limits or less in these ranges, the durability (for example, wear resistance and sticking force) as the resin coating can be ensured. The volume ratio of any component excluding the heat resistant resin and the damping filler in the damping resin layer is not specifically limited, and the volume ratio of any component can be selected depending on the type.

While the damping resin layer is not specifically limited and only needs to suppress the vibration transmission of the desired frequency, for example, the vibration transmission of the frequency of 2 kHz is suppressed in some embodiments. This is because the noise can be especially effectively suppressed. For adjusting the damping resin layer to suppress the vibration transmission of the desired frequency, for example, it is only necessary to adjust the types and the contents of the respective components such as the damping filler and the heat resistant resin in the damping resin layer, the thickness of the damping resin layer, and the like. The damping resin layer may be a layer that doubles as the liquid gasket.

While the method for forming the damping resin layer is not specifically limited, for example, a method below is included.

First, a predetermined amount of heat resistant resin is dissolved in an organic solvent, thus preparing a dissolution liquid. Next, a predetermined amount of damping filler is added to the dissolution liquid, and any component is further added as necessary, thus preparing a coating material by kneading. Next, the coating material is applied over the abutment surface that abuts on the internal combustion engine main body of the chain cover main body. Next, the coating material applied over the chain cover main body is heated, dried, and hardened. Thus, the damping resin layer is formed.

The organic solvent used in the above-described method is not specifically limited and selected depending on the type of the heat resistant resin. For example, when a polyamide-imide resin is used as the heat resistant resin, the organic solvent includes N-methyl-2-pyrrolidone (NMP), N-ethyl-2-pyrrolidone (NEP), 1,3-dimethyl-2-imidazolidinone (DMI), γ-butyrolactone (GBL), and the like. When an epoxy resin is used, methyl ethyl ketone (MEK), toluene, and the like are included.

The kneading method for preparing the coating material includes, for example, a method in which a kneader is used and the kneading is performed for one hour. While the method for applying the coating material over the chain cover main body is not specifically limited and a common coating method is usable, a spray coating, a screen-printing, a dipping, and the like are included. The heating condition for drying and hardening the coating material is not specifically limited, and the heating condition includes, for example, a condition of heating at the temperature of 100° C. or more and 370° C. or less for a period of 30 minutes or more and three hours or less.

2. Mounting Structure for Timing Chain Cover

The mounting structure for the timing chain cover is a structure in which the timing chain cover that houses the timing chain transmitting the rotative force of the crankshaft to the camshaft in one end side of the internal combustion engine is mounted to the internal combustion engine main body. In the mounting structure for the timing chain cover, the damping resin layer is disposed between the abutment surface of the chain cover main body included in the timing chain cover and the abutment surface of the internal combustion engine main body. The damping resin layer contains the heat resistant resin and the damping filler that converts the vibration energy into the heat energy.

In the mounting structure for the timing chain cover, while the damping resin layer may be formed on the abutment surface of the internal combustion engine main body and included in the internal combustion engine main body, the damping resin layer is formed on the abutment surface of the chain cover main body and included in the timing chain cover in some embodiments. This is because the handling of the members in the damping resin layer formation process and the like is facilitated and an advantage in the cost is also provided compared with the case where the damping resin layer is formed on the abutment surface of the internal combustion engine main body and included in the internal combustion engine main body. The damping resin layer may include two damping resin layers formed on the respective abutment surfaces in both the internal combustion engine main body side and the chain cover main body side.

Since the thickness of the damping resin layer, and the heat resistant resin and the damping filler contained in the damping resin layer are similar to those described in "1. Timing Chain Cover (2) Damping Resin Layer," the description is omitted here.

EXAMPLES

The following further specifically describes the timing chain cover and the mounting structure for the timing chain cover according to the embodiments with examples and a comparative example.

Example 1

First, the coating material used for forming the damping resin layer of the timing chain cover was prepared. Specifically, first, a polyamide-imide resin was prepared as the heat resistant resin, and a predetermined amount of the polyamide-imide resin was dissolved in N-ethyl-2-pyrrolidone (NEP) (organic solvent), thus preparing the dissolution liquid. Next, a thermoplastic elastomer was prepared as the damping filler, a predetermined amount of the thermoplastic elastomer was added to the dissolution liquid, and kneaded for one hour using a kneader. Thus, the coating material was prepared so as to have 50 volume % of the volume ratio of the damping filler to the total volume of the heat resistant resin and the damping filler in the damping resin layer.

Subsequently, a test piece in which a damping resin layer was formed on a surface of a block-shaped substrate was prepared. Specifically, first, the block-shaped substrate containing SUS440C was prepared, and a predetermined amount of the coating material was applied over a surface of the substrate by spray coating. Next, by heating the coating material applied over the substrate at 180° C. for 90 minutes, the organic solvent was volatilized, and the coating material was dried and hardened. Thus, the damping resin layer having the thickness of 1 μm was formed on the surface of the substrate, thereby preparing the test piece.

Example 2

The test piece was prepared similarly to Example 1 except that the damping resin layer was formed so as to have the thickness of 5 μm.

Example 3

The test piece was prepared similarly to Example 1 except that the damping resin layer was formed so as to have the thickness of 10 μm.

Example 4

The test piece was prepared similarly to Example 1 except that the damping resin layer was formed so as to have the thickness of 20 μm.

Example 5

The test piece was prepared similarly to Example 1 except that the damping resin layer was formed so as to have the thickness of 50 μm.

Example 6

The test piece was prepared similarly to Example 1 except that the damping resin layer was formed so as to have the thickness of 100 μm.

Example 7

First, the test piece was prepared similarly to Example 1 except that the damping resin layer was formed so as to have the thickness of 200 μm.

Subsequently, the timing chain cover in which the damping resin layer was formed was mounted to the engine together with the cylinder block and the cylinder head (engine main body) without the damping resin layer, thus preparing a mounted timing chain cover.

Specifically, first, a chain cover main body made of an aluminum die cast material was prepared. Next, a predetermined amount of the coating material similar to that of Example 1 was applied over the abutment surface that abuts on the cylinder block and the cylinder head of the chain cover main body by spray coating. Next, by heating the coating material at 180° C. for 90 minutes, the organic solvent was volatilized, and the coating material was dried and hardened. Thus, the damping resin layer having the thickness of 200 μm was formed on the abutment surface of the chain cover main body.

Next, the cylinder block, the cylinder head, the crankshaft, the camshaft, the sprocket, the timing chain, and the like were prepared. Next, they were assembled, thus mounting the camshaft driving mechanism to the surface in one end side of the engine main body. Next, the timing chain cover in which the damping resin layer was formed on the abutment surface of the chain cover main body was mounted to the surface in the one end side of the engine main body. At this time, the damping resin layer was disposed between the abutment surface of the chain cover main body and the abutment surface of the engine main body. Thus, the mounted timing chain cover was prepared.

Subsequently, the timing chain cover without the damping resin layer was mounted to the engine together with the cylinder block and the cylinder head (engine main body) in which the damping resin layer was formed, thus preparing a mounted timing chain cover.

Specifically, first, the cylinder block and the cylinder head were prepared. Next, a predetermined amount of the coating material similar to that of Example 1 was applied over the abutment surfaces that abuts on the chain cover main body of the cylinder block and the cylinder head by spray coating. Next, by heating the coating material at 180° C. for 90 minutes, the organic solvent was volatilized, and the coating material was dried and hardened. Thus, the damping resin layer having the thickness of 200 μm was formed on the abutment surfaces of the cylinder block and the cylinder head.

Next, the crankshaft, the camshaft, the sprocket, the timing chain, and the like were prepared. Next, they were assembled together with the cylinder block and the cylinder head in which the damping resin layer was formed, thus mounting the camshaft driving mechanism to the surface in one end side of the engine main body. Next, the timing chain cover in which the damping resin layer was not formed on the abutment surface of the chain cover main body was prepared and mounted to the surface in the one end side of the engine main body. At this time, the damping resin layer was disposed between the abutment surface of the chain cover main body and the abutment surface of the engine main body. Thus, the mounted timing chain cover was prepared.

Subsequently, the timing chain cover in which the damping resin layer was formed was mounted to the engine together with the cylinder block and the cylinder head (engine main body) in which the damping resin layer was formed, thus preparing a mounted timing chain cover.

Specifically, first, similarly to the above, the damping resin layer having the thickness of 200 μm was formed on the abutment surface of the chain cover main body. Next, similarly to the above, the damping resin layer having the thickness of 200 μm was formed on the abutment surfaces of the cylinder block and the cylinder head.

Next, the crankshaft, the camshaft, the sprocket, the timing chain, and the like were prepared. Next, they were assembled together with the cylinder block and the cylinder head in which the damping resin layer was formed, thus mounting the camshaft driving mechanism to the surface in one end side of the engine main body. Next, the timing chain cover in which the damping resin layer was formed on the abutment surface of the chain cover main body was mounted to the surface in the one end side of the engine main body. At this time, the damping resin layers were disposed on both sides between the abutment surface of the chain cover main body and the abutment surface of the engine main body. Thus, the mounted timing chain cover was prepared.

Example 8

First, the coating material was prepared similarly to Example 1 except that a urethane resin was prepared as the damping filler and added to the dissolution liquid by a predetermined amount.

Subsequently, the test piece was prepared similarly to Example 1 except that the damping resin layer was formed so as to have the thickness of 100 μm by using the coating material prepared in this example.

Example 9

First, the test piece was prepared similarly to Example 8 except that the damping resin layer was formed so as to have the thickness of 200 μm.

Subsequently, the timing chain cover in which the damping resin layer was formed was mounted to the engine together with the cylinder block and the cylinder head (engine main body) without the damping resin layer, thus preparing a mounted timing chain cover similarly to Example 7 except that the coating material similar to that of Example 8 was used.

Subsequently, the timing chain cover without the damping resin layer was mounted to the engine together with the cylinder block and the cylinder head (engine main body) in which the damping resin layer was formed, thus preparing a mounted timing chain cover similarly to Example 7 except that the coating material similar to that of Example 8 was used.

Subsequently, the timing chain cover in which the damping resin layer was formed was mounted to the engine together with the cylinder block and the cylinder head (engine main body) in which the damping resin layer was formed, thus preparing a mounted timing chain cover similarly to Example 7 except that the coating material similar to that of Example 8 was used.

Example 10

First, the coating material was prepared similarly to Example 1 except that a silicone resin was prepared as the damping filler and added to the dissolution liquid by a predetermined amount.

Subsequently, the test piece was prepared similarly to Example 1 except that the damping resin layer was formed so as to have the thickness of 100 μm by using the coating material prepared in this example.

Example 11

First, the test piece was prepared similarly to Example 10 except that the damping resin layer was formed so as to have the thickness of 200 μm.

Subsequently, the timing chain cover in which the damping resin layer was formed was mounted to the engine together with the cylinder block and the cylinder head (engine main body) without the damping resin layer, thus preparing a mounted timing chain cover similarly to Example 7 except that the coating material similar to that of Example 10 was used.

Subsequently, the timing chain cover without the damping resin layer was mounted to the engine together with the cylinder block and the cylinder head (engine main body) in which the damping resin layer was formed, thus preparing a mounted timing chain cover similarly to Example 7 except that the coating material similar to that of Example 10 was used.

Subsequently, the timing chain cover in which the damping resin layer was formed was mounted to the engine together with the cylinder block and the cylinder head (engine main body) in which the damping resin layer was formed, thus preparing a mounted timing chain cover similarly to Example 7 except that the coating material similar to that of Example 10 was used.

Example 12

First, the coating material was prepared similarly to Example 1 except that a microcapsule was prepared as the damping filler and added to the dissolution liquid by a predetermined amount.

Subsequently, the test piece was prepared similarly to Example 1 except that the damping resin layer was formed so as to have the thickness of 100 μm by using the coating material prepared in this example.

Example 13

First, the test piece was prepared similarly to Example 12 except that the damping resin layer was formed so as to have the thickness of 200 μm.

Subsequently, the timing chain cover in which the damping resin layer was formed was mounted to the engine together with the cylinder block and the cylinder head (engine main body) without the damping resin layer, thus preparing a mounted timing chain cover similarly to Example 7 except that the coating material similar to that of Example 12 was used.

Subsequently, the timing chain cover without the damping resin layer was mounted to the engine together with the cylinder block and the cylinder head (engine main body) in which the damping resin layer was formed, thus preparing a mounted timing chain cover similarly to Example 7 except that the coating material similar to that of Example 12 was used.

Subsequently, the timing chain cover in which the damping resin layer was formed was mounted to the engine together with the cylinder block and the cylinder head (engine main body) in which the damping resin layer was formed, thus preparing a mounted timing chain cover similarly to Example 7 except that the coating material similar to that of Example 12 was used.

Comparative Example

First, a block-shaped substrate similar to that of Example 1 was prepared, and directly used as the test piece without forming the damping resin layer.

Subsequently, a mounted timing chain cover was prepared similarly to Examples 7, 9, 11, and 13 except that the timing chain cover without the damping resin layer was mounted to the engine together with the cylinder block and the cylinder head (engine main body) in which the damping resin layer was not formed.

[Evaluation of Influence of Damping Resin Layer Thickness on NV Performance in Falling Ball Test]

Figure 5:
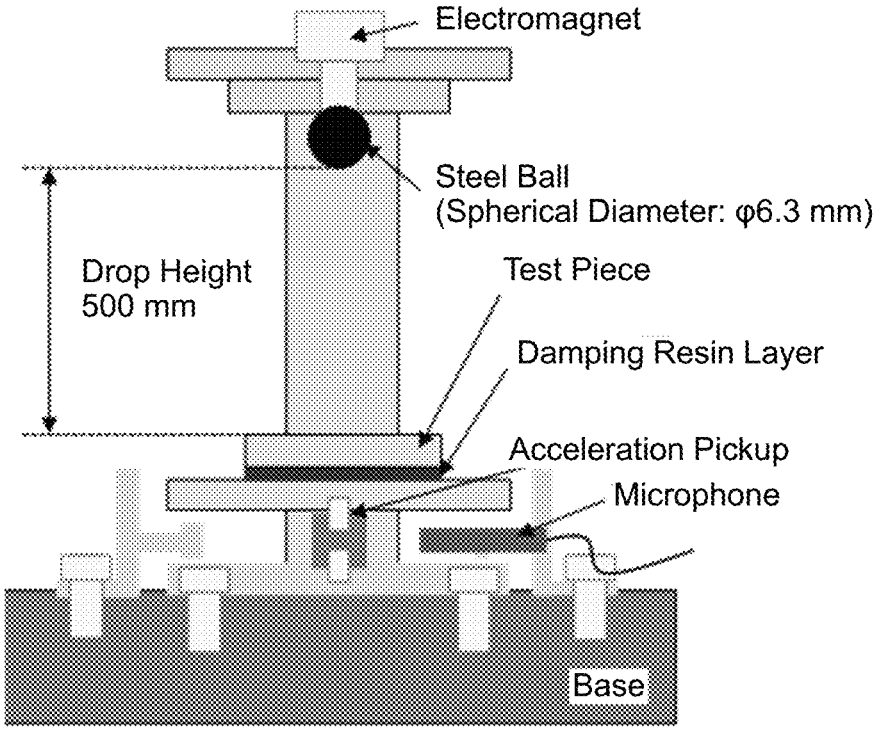
FIG. 5 is a cross-sectional view schematically illustrating a falling ball tester.

The falling ball test was performed for the test pieces obtained in Examples 1 to 13 and Comparative Example, and the influence of the damping resin layer thickness on the NV perform was evaluated. FIG. 5 is a cross-sectional view schematically illustrating a falling ball tester.

Figure 6:
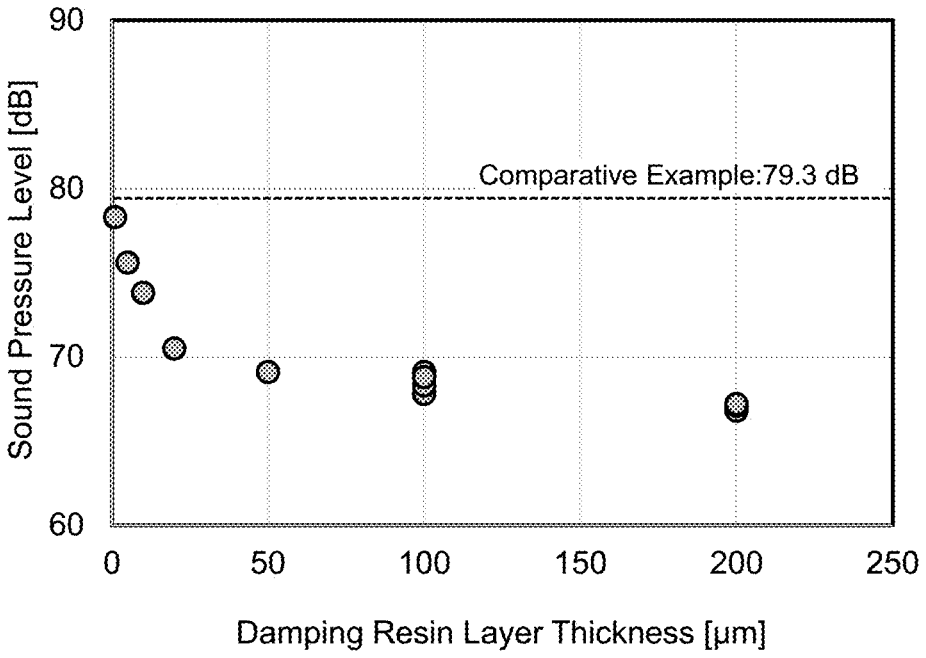
FIG. 6 is a graph illustrating sound pressure levels of sounds generated at steel ball collision relative to a thickness of a damping resin layer in test pieces of Examples 1 to 13 and Comparative Example.

In the falling ball test, as illustrated in FIG. 5, the test piece was placed on a steel plate on an acceleration pickup installed in the upper portion of the base of the falling ball tester. When the test pieces of Examples 1 to 13 were placed, the damping resin layers were in contact with the steel plate. This is because the purpose of the falling ball test is the measurement of the degree of noise suppression when an impact is applied to the damping resin layer disposed between a component and another component. In the falling ball tester, a steel ball of φ6.3 mm made of SUJ2 is held immediately above the test piece by an electromagnet. In the falling ball test, the height of the steel ball before falling (distance from test piece upper surface) was set to 500 mm, and the magnetic force of the falling ball tester was turned off to drop the steel ball, thereby causing a collision of the steel ball against the test piece. A sound generated in the collision was collected by a microphone installed immediately above the test piece, and a sound pressure level of an overall value in the frequency band of 20 Hz to 10 kHz was measured. Table 1 below illustrates the measurement result. FIG. 6 is a graph illustrating the sound pressure levels of the sounds generated at the steel ball collision relative to the thickness of the damping resin layer in the test pieces of Examples 1 to 13 and Comparative Example.

As illustrated in Table 1 below and FIG. 6, since the sound pressure level decreases in association with the increase of the damping resin layer thickness, the NV performance is considered to be improved in association with the increase of the damping resin layer thickness. In the comparison between the test piece including only the substrate of Comparative Example and the test pieces of Examples 1 to 7 having the same composition of the damping resin layer, for the test pieces having the damping resin layer thickness thinner than 10 μm, while the effect of sound pressure level reduction is recognized in comparison with the test piece including only the substrate, the significant reduction effect is not recognized. Meanwhile, for the test pieces having the damping resin layer thickness of 10 μm or more, the effect of sound pressure level reduction of 5 dB or more is recognized in comparison with the test piece including only the substrate. Therefore, it is considered that the thickness of the damping resin layer is 10 μm or more in some embodiments, may be 20 μm or more, and may be 50 μm or more. Furthermore, as illustrated in Table 1 below and FIG. 6, even when the type of the damping filler in the damping resin layer is changed, the similar tendency is recognized.

[Evaluation of NV Performance of Mounted Timing Chain Cover]

The NV performance of the mounted timing chain covers obtained in Examples 7, 9, 11, and 13 and Comparative Example was evaluated. In the NV performance evaluation of the mounted timing chain covers obtained in Examples 7, 9, 11, and 13, the NV performance was evaluated for each of three types of the damping resin layer formation position of the chain cover main body side, the engine main body side, and both sides.

Figure 7:
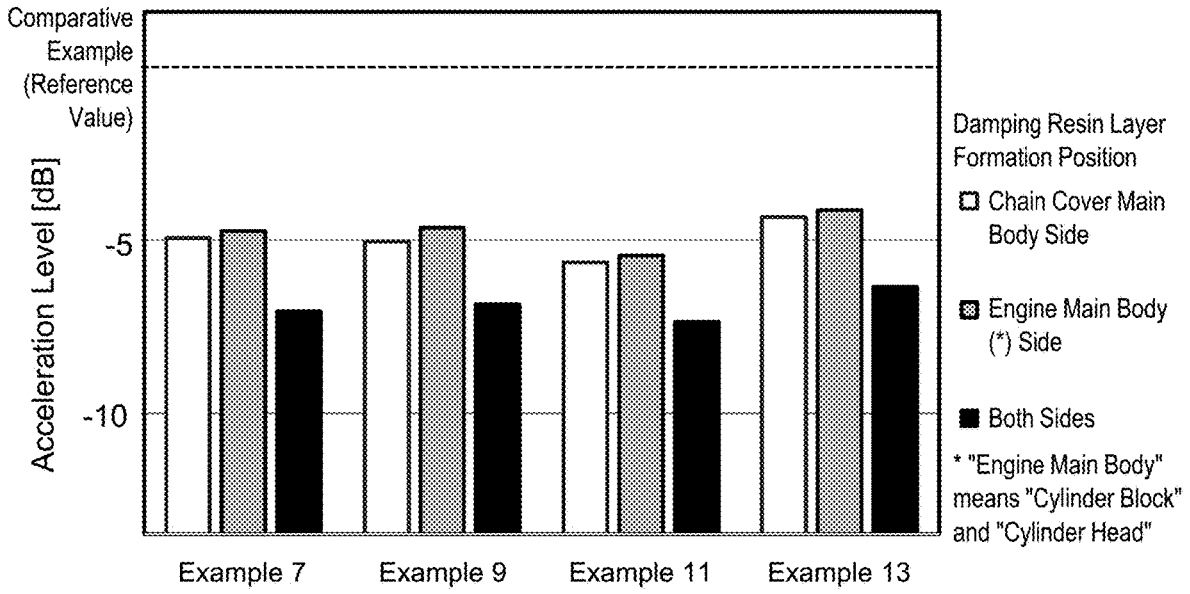
FIG. 7 is a graph illustrating acceleration levels of vibrations transmitted to the chain cover main bodies of the mounted timing chain covers with different formation portions of the damping resin layers obtained in Examples 7, 9, 11, and 13.

Specifically, the acceleration pickup was installed to the surface in the opposite side of the damping resin layer of the mounted timing chain cover. Subsequently, the engine to which the mounted timing chain cover was mounted was rotated by the motor with the rotation speed of 2000 rpm, thereby driving the engine. Thus, an acceleration level of an overall value of the vibration in the frequency band of 20 Hz to 20 kHz transmitted to the chain cover main body was measured by the acceleration pickup. Table 1 below illustrates the measurement result. FIG. 7 is a graph illustrating the acceleration levels of vibrations transmitted to the chain cover main bodies of the mounted timing chain covers with different formation portions of the damping resin layers obtained in Examples 7, 9, 11, and 13. In Table 1 below and the graph of FIG. 7, the acceleration level of Comparative Example was assumed as the reference value, and the acceleration levels of Examples were indicated by relative values to the reference value.

As illustrated in Table 1 below and FIG. 7, in the mounted timing chain covers obtained in Examples 7, 9, 11, and 13 in which the damping resin layer formation positions are different, the effect of significant reduction of acceleration level is recognized regardless of the damping resin layer formation position compared with the mounted timing chain cover obtained in Comparative Example. It is considered that when the damping resin layer is formed on the chain cover main body side, the engine main body side, or both sides, the transmission of the vibration between the engine main body and the chain cover main body is suppressed by the damping resin layer, thus reducing the acceleration level.

TABLE 1

| | Damping Resin Layer | | | falling ball test Sound | NV Performance of Mounted Timing Chain Cover Damping Resin Layer Formation Position | | |
|---|---|---|---|---|---|---|---|
| | | | | | Chain Cover Main Body Side | Engine Main Body (*) Side | Both Sides |
| | Heat Resistant Resin | Damping Filler | Thickness [μm] | Pressure Level [dB] | Acceleration Level [dB] | Acceleration Level [dB] | Acceleration Level [dB] |
| Comparative Example | Without Damping Resin Layer | | | 79.3 | Reference Value | Reference Value | Reference Value |
| Example 1 | Polyamide Imide | Thermoplastic Elastomer | 1 | 78.3 | — | — | — |
| Example 2 | | | 5 | 75.6 | — | — | — |
| Example 3 | | | 10 | 73.8 | — | — | — |
| Example 4 | | | 20 | 70.5 | — | — | — |
| Example 5 | | | 50 | 69.1 | — | — | — |
| Example 6 | | | 100 | 67.8 | — | — | — |
| Example 7 | | | 200 | 66.9 | −4.9 | −4.7 | −7 |
| Example 8 | | Urethane Resin | 100 | 68.3 | — | — | — |
| Example 9 | | | 200 | 66.8 | −5 | −4.6 | −6.8 |
| Example 10 | | Silicone Resin | 100 | 69.1 | — | — | — |
| Example 11 | | | 200 | 67.1 | −5.6 | −5.4 | −7.3 |
| Example 12 | | Microcapsule | 100 | 68.8 | — | — | — |
| Example 13 | | | 200 | 67.2 | −4.3 | −4.1 | −6.3 |

* "Engine Main Body" means "Cylinder Block" and "Cylinder Head"

While the embodiments of the timing chain cover and the mounting structure for the timing chain cover according to the present disclosure have been described in detail above, the present disclosure is not limited to the above-described embodiments, and can be subjected to various kinds of changes in design without departing from the spirit or scope of the present disclosure described in the claims.

All publications, patents and patent applications cited in the present description are herein incorporated by reference as they are.

DESCRIPTION OF SYMBOLS

E Engine (internal combustion engine)
1 Cylinder block (engine main body)
4 Timing chain cover
4*a* Chain cover main body
4*as* Abutment surface
4*b* Damping resin layer
4*ba* Upper damping resin layer
4*bb* Intermediate damping resin layer
4*bc* Lower damping resin layer
4*bs* Surface

6 Liquid gasket
11 Cylinder head (engine main body)
12 Crankcase (engine main body)
14 Intake camshaft
15 Exhaust camshaft
16 Crankshaft
21 Crank sprocket
22 Intake cam sprocket
23 Exhaust cam sprocket
24 Timing chain
25 Chain tensioner device
26 Chain vibration damper
27 Timing chain guide
31 Oil pump driving sprocket
32 Oil pump
32*a* Oil pump sprocket
33 Oil pump drive chain

What is claimed is:

1. A timing chain cover for housing a timing chain transmitting a rotative force of a crankshaft to a camshaft in one end side of an internal combustion engine, the timing chain cover comprising:

a chain cover main body; and a damping resin layer formed on an abutment surface of the chain cover main body, the abutment surface abutting on an internal combustion engine main body, wherein the damping resin layer contains a heat resistant resin and a damping filler, the damping filler converting a vibration energy into a heat energy.

2. The timing chain cover according to claim 1, wherein the damping resin layer has a thickness of 10 μm or more.

3. A mounting structure for a timing chain cover, the timing chain cover being mounted to an internal combustion engine main body with the mounting structure, the timing chain cover housing a timing chain transmitting a rotative force of a crankshaft to a camshaft in one end side of the internal combustion engine, the mounting structure comprising a damping resin layer disposed between an abutment surface of a chain cover main body included in the timing chain cover and an abutment surface of the internal combustion engine main body, wherein the damping resin layer contains a heat resistant resin and a damping filler, the damping filler converting a vibration energy into a heat energy.

4. The mounting structure for a timing chain cover according to claim 3, wherein the damping resin layer is formed on the abutment surface of the chain cover main body, the damping resin layer being included in the timing chain cover.

5. The mounting structure for a timing chain cover according to claim 3, wherein the damping resin layer has a thickness of 10 μm or more.

* * * * *